US005084711A

United States Patent [19]

Moss et al.

[11] Patent Number: 5,084,711

[45] Date of Patent: Jan. 28, 1992

[54] MICROWAVE AND MILLIMETRIC WAVE RECEIVERS

[75] Inventors: Graham H. Moss; Andrew P. Wood, both of Stevenage, United Kingdom

[73] Assignee: British Aerospace Public Limited Company, London, England

[21] Appl. No.: 351,278

[22] Filed: May 8, 1989

Related U.S. Application Data

[63] Continuation of Ser. No. 933,195, Nov. 19, 1986, abandoned.

[30] Foreign Application Priority Data

Oct. 2, 1986 [GB] United Kingdom ..... 8524248

[51] Int. Cl.[5] ..... H01Q 15/08

[52] U.S. Cl. ..... 343/911 R; 343/911 L

[58] Field of Search ..... 343/909, 911 R, 911 L, 343/703

[56] References Cited

U.S. PATENT DOCUMENTS

| | | | |
|---|---|---|---|
| 2,668,869 | 2/1954 | Lams | 343/755 |
| 3,287,728 | 11/1966 | Atlas | 343/753 |
| 4,287,603 | 9/1981 | Moser | 455/293 |
| 4,305,075 | 12/1981 | Salvat et al. | 342/188 |
| 4,581,615 | 4/1986 | Levy | 343/755 |

*Primary Examiner*—Gregory C. Issing

*Attorney, Agent, or Firm*—Cushman, Darby & Cushman

[57] ABSTRACT

Receiver apparatus for receiving electromagnetic target radiation polarized in a first direction includes a dielectric lens having forward and rearward surfaces. The received target radiation is refracted at the forward surface and reflected by the rearward surface. An antenna array is disposed adjacent one of the forward and rearward surfaces for receiving (a) the target radiation reflected from the rearward surface, and (b) a local oscillator beam haivng a polarization direction which is orthogonal to the polarization direction of the target radiation received at the antenna array.

5 Claims, 1 Drawing Sheet

MICROWAVE AND MILLIMETRIC WAVE RECEIVERS

This is a continuation of application Ser. No. 06/933,195, filed Nov. 19, 1986, which was abandoned upon the filing hereof.

BACKGROUND OF THE INVENTION

This invention relates to receivers operating in the microwave and millimeter wavebands which comprise a dielectric lens which focusses incoming radiation onto a detector array. In particular, but not exclusively, this invention relates to such receivers for surveillance and/or tracking systems, for example for missiles.

In such applications it is desireable to have a light and compact arrangement with a high relative aperture (typically f1.0) and a wide field of view.

In one system, the dielectric lens focusses incoming radiation onto an array of crossed dipoles (typically 8×8) or slots interconnected with each other and with an IF output circuit by means of diodes which, together with the components of the IF circuit may be formed monolithically in a substrate of material of the same dielectric constant as the lens material attached to the lens. The two dipoles of each pair respond respectively to the linearly polarised received radiation and to an orthogonally linearly polarised local oscillator signal which is radiated directly on to the array and these two signals are mixed to form an IF signal.

The local oscillator signal may be radiated onto the antenna/mixer array in the same direction as the incoming received radiation, for example by employing a patch antenna located on the front surface of the lens or by means of a polarising reflector located either forwardly of the lens or in the lens material itself and supplied with a local oscillator signal from a transversely directed source.

In order to achieve the collection and focussing of radiation several systems have been proposed; a lens in combination with one or more reflectors; a two lens arrangement, and a single large lens element. These systems can be large and heavy and the performance and field of view can be limited. These properties therefore militate against adoption of the receiver in environments where space and weight allowances are limited.

SUMMARY OF THE INVENTION

According to one aspect of this invention, there is provided a receiver for receiving electromagnetic radiation and including dielectric lens means having a forward surface and a rearward surface, and an array of antenna elements located adjacent one of said forward and rearward surfaces, at least part of the other of said forward and rearward surfaces being reflective to said received radiation, said lens being formed such that incident radiation is initially refracted on passing into said lens and then reflected by said reflective surface onto said array.

In a preferred arrangement the array of elements is located adjacent said forward surface of said lens means and said rearward surface is reflective to radiation. Alternatively, the array of elements may be located adjacent the rearward surface, with both forward and rearward surfaces of the lens selectively reflective to radiation such that radiation refracted at the forward surface is reflected by the rearward surface back onto the forward surface, thence to be reflected on to the array of antenna elements.

BRIEF DESCRIPTION OF THE DRAWINGS

Further aspects will become apparent from the following description, which is by way of example only, reference being made to the accompanying drawings, in which.

DETAILED DESCRIPTION OF THE PREFERRED EMBODIMENT

Referring to the FIGURES, there are shown two forms of receiver for receiving radiation in the millimetric or microwave wavebands, typically 35 to 95 GHz. The receivers are intended for use in tracking arrangements in which a beam of radiation polarised in a given direction is transmitted from a transmitter (not shown) towards an object (or target) to be tracked whence it is reflected back to the receiver and focussed onto an array of antenna/mixer elements together with a local oscillator signal which is polarised in a direction orthogonal to that of the received signal.

Figure 1:
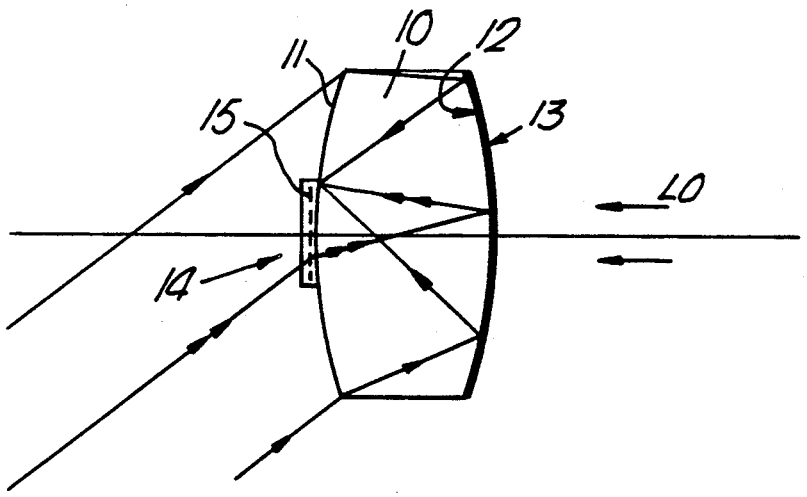
FIG. 1 is a schematic view of a first form of receiver of this invention.

Referring initially to FIG. 1, the receiver includes a single lens element 10, having forward and rearward surfaces 11 and 12 respectively, and formed of a dielectric material which transmits in the wavelength of interest with minimal loss. An example of a suitable form of material is titania loaded polystyrene having a dielectric constant of at least 10 and a loss tangent of not greater than 0.001. The rearward surface 11 of the lens is rendered reflective to the received radiation, for example by applying a reflecting material such as aluminium as a metalised layer 13. Connected to the forward surface 12 of the lens is a dielectric substrate 14 carrying a planar integrated array 15 of antenna/mixers each comprising a pair of crossed dipoles. In each case one of the dipoles in each pair is responsive to linearly polarised radiation reflected from the tracked object whilst the other dipole is responsive to linearly polarised local oscillator radiation received in a manner described below.

Radiation incident on the forward surface of the lens is refracted at that surface and thereafter passes to the rearward surface to be reflected onto the array 15. To improve the transmission characteristics of the lens a multilayer dielectric coating may be applied to the forward surface.

A local oscillator signal is radiated through the rearward surface 12 of the lens onto the array by means of a microwave horn (not shown). To enable transmission of the local oscillator signal through the rearward surface an aperture may be provided in the reflective coating, or the coating may be polarisation sensitive—e.g. a polarising grid—, transmitting with minimal loss the polarised local oscillator signal but reflecting the orthogonally polarised received radiation.

Two lens elements operating on the above principle were designed and tested, one (Example I) having an aspherical forward surface and a spherical rearward surface, and the other (Example II) having aspherical forward and rearward surfaces. The lens material is titania loaded polystyrene.

| Example I | | | |
|---|---|---|---|
| Surface | Radius of curvature (mm) | Separation (mm) | Diameter (mm) |
| Forward | 119.5901 | | 100.0 |
| | | 50.0 | |
| Rearward | 166.7242 | | 100.0 |
| Forward Surface Aspheric Parameters: | | | |
| Conic Constant: −96.69 | | $A_4$: | 0.3304 E-5 |
| | | $A_6$: | −0.2120 E-8 |
| | | $A_8$: | 0.5770 E-12 |
| | | $A_{10}$: | −0.4822 E-16 |
| Focal Length: 70.0 mm | | | |

The performance of this lens over a ±36.5° field is diffraction limited in the wavelength of interest.

| Example II | | | |
|---|---|---|---|
| Surface | Radius of curvature (mm) | Separation (mm) | Diameter (mm) |
| Forward | 95.7534 | | 100.0 |
| | | 50.0 | |
| Rearward | 225.0082 | | 100.0 |
| Forward Surface Aspheric Parameters: | | | |
| Conic Constant: −46.428 | | $A_4$: | 0.3089 E-5 |
| | | $A_6$: | −0.1858 E-8 |
| | | $A_8$: | 0.5909 E-12 |
| | | $A_{10}$: | −0.7655 E-16 |
| Rearward Surface Aspheric Parameters: | | | |
| Conic Constant: 1.706 | | $A_4$: | −0.8153 E-6 |
| | | $A_6$: | 0.1057 E-8 |
| | | $A_8$: | −0.5914 E-12 |
| | | $A_{10}$: | 0.1115 E-15 |
| Focal Length: 77.8 mm | | | |

The performance of this lens over a ±33.6° field is diffraction limited in the wavelength of interest.

Figure 2:
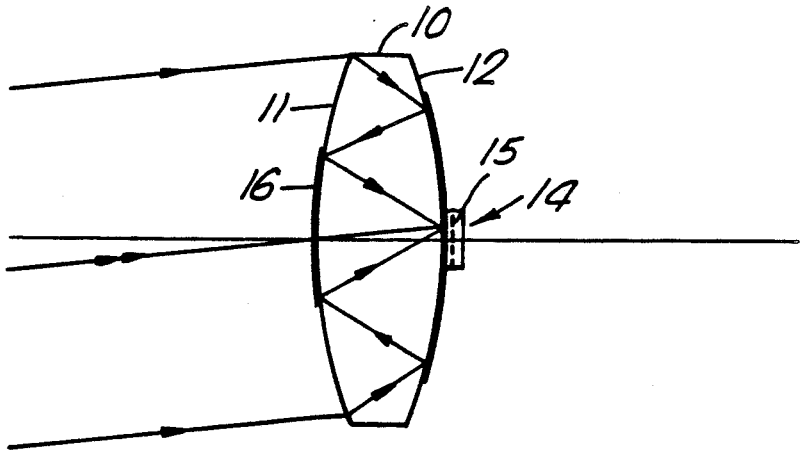
FIG. 2 is a schematic view of a second form of receiver.

Referring now to FIG. 2, it is also possible to utilise the forward surface 11 of the lens to give an extra reflecting surface. In this case, the incident radiation will undergo one refraction on passing through the forward surface 11, thereafter to be reflected off the rearward surface 12 back onto the forward surface 11 thence onto a planar array 15 of antenna/mixer elements on substrate 14 attached to the rear of the lens. In this case, the local oscillator signal may be applied directly onto the rear of the array substrate. A reflecting layer, or polarising sensitive surface would have to be applied to a central zone 16 of the forward surface 11. The use of a polarisation sensitive surface would minimise the signal loss since on entering the lens the linearly polarised received signal would pass through the polarisation sensitive surface with minimum loss, but after reflection from the rearward surface the radiation would be orthogonally polarised and thus would be reflected by the forward surface onto the array of antenna mixer elements. Thus the obscuration on forward surface 11 would effectively be removed.

A lens element operating on this principle was designed and tested. The lens material was titania loaded polystyrene and both forward and rearward surfaces were aspherical, and parameters are given in the following Example.

-continued

| Example III | | | |
|---|---|---|---|
| Surface | Radius of curvature (mm) | Separation (mm) | Diameter (mm) |
| Forward | 237.7165 | | 100.0 |
| | | 50.0 | |
| Rearward | 110.6019 | | 100.0 |
| Forward Surface Aspheric Parameters: | | | |
| Conic Constant: −0.4338 | | $A_4$: | 0.3515 E-5 |
| | | $A_6$: | −0.2416 E-9 |
| | | $A_8$: | −0.2671 E-12 |
| | | $A_{10}$: | 0.8362 E-16 |
| Rearward Surface Aspheric Parameters: | | | |
| Conic Constant: −2.5524 | | $A_4$: | 0.8919 E-6 |
| | | $A_6$: | 0.4679 E-9 |
| | | $A_8$: | 0.9268 E-13 |
| | | $A_8$: | 0.9268 E-13 |
| | | $A_{10}$: | −0.8362 E-16 |
| Focal Length: 77.8 mm | | | |

The performance of this lens over a ±6.0° field is diffraction limited in the wavelength of interest.

In the above examples, the aspheric parameters referred to are those in the following lens formula:

$$Z = \left( \frac{CR^2}{1 + (1 - (1 + K) \cdot C^2 \cdot R^2)1/2} \right) + A_4R^4 + A_6R^6 + A_8R^8 + A_{10}R^{10}$$

where:

Z=Lens Profile

C=Surface Curvature

K=Conic Constant

R=Radius

We claim:

1. Receiver apparatus for receiving electromagnetic target radiation polarized in a first direction, comprising:

a dielectric lens means having forward and rearward surfaces, for refracting the target radiation through said forward surface and reflecting said target radiation from said rearward surface; and antenna means, disposed adjacent one of said forward and rearward surfaces, for receiving (a) said target radiation reflected from said rearward surface, and (b) a local oscillator beam having a polarization orthogonal to the polarization direction of the target radiation received at said antenna means wherein said antenna means includes a plurality of crossed dipole pairs, each of said plurality of dipole pairs including one dipole responsive to said polarization direction of the received target radiation, and another dipole responsive to said orthogonal polarization local oscillator beam.

2. Receiver apparatus for receiving electromagnetic target radiation polarized in a first direction, comprising:

a dielectric lens means having forward and rearward surfaces, for refracting the target radiation through said forward surface and reflecting said target radiation from said rearward surface; and antenna means, disposed adjacent one of said forward and rearward surfaces, for receiving (a) said target radiation reflected from said rearward surface, and (b) a local oscillator beam having a polarization orthogonal to the polarization direction of the target radiation received at said antenna means wherein said rearward surface includes polarization sensitive means for reflecting said first polarization target radiation while passing therethrough said orthogonal polarization local oscillator beam.

3. Receiver apparatus for receiving electromagnetic target radiation polarized in a first direction, comprising:

a dielectric lens means having forward and rearward surfaces, for refracting the target radiation through said forward surface and reflecting said target radiation from said rearward surface; and antenna means, disposed adjacent one of said forward and rearward surfaces, for receiving (a) said target radiation reflected from said rearward surface, and (b) a local oscillator beam having a polarization orthogonal to the polarization direction of the target radiation received at said antenna means wherein said rearward surface includes means for passing therethrough at least a portion of said orthogonal polarization local oscillator beam.

4. Receiver apparatus for receiving electromagnetic target radiation polarized in a first direction, comprising:

a dielectric lens means having forward and rearward surfaces, for refracting the target radiation through said forward surface and reflecting said target radiation from said rearward surface; and antenna means, disposed adjacent one of said forward and rearward surfaces, for receiving (a) said target radiation reflected from said rearward surface, and (b) a local oscillator beam having a polarization orthogonal to the polarization direction of the target radiation received at said antenna means wherein said forward surface includes means for reflecting (a) the target radiation reflected from said rearward surface, and wherein said forward surface reflecting means comprises a polarization sensitive material for passing therethrough said first polarization target radiation while reflecting radiation polarized orthogonal to said first direction.

5. Receiver apparatus for receiving electromagnetic radiation polarized in a first direction, comprising:

dielectric lens means having forward and rearward surfaces, for refracting the received radiation through said forward surface and reflecting said received radiation from said rearward surface with a second polarization direction, means for passing thru said rearward surface a local oscillator beam polarized in said first direction; and antenna means disposed adjacent said forward surface for receiving (a) the second polarization radiation reflected from said rearward surface, and (b) said local oscillator beam polarized in said first direction.

* * * * *